US011239600B2

(12) United States Patent
Ishikawa et al.

(10) Patent No.: US 11,239,600 B2
(45) Date of Patent: Feb. 1, 2022

(54) HOUSING WITH AN ENGAGING PIECE

(71) Applicant: YAZAKI CORPORATION, Tokyo (JP)

(72) Inventors: Yoshinori Ishikawa, Makinohara (JP); Ryosuke Ohfuku, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/870,888

(22) Filed: May 8, 2020

(65) Prior Publication Data

US 2020/0395706 A1 Dec. 17, 2020

(30) Foreign Application Priority Data

Jun. 11, 2019 (JP) ..... JP2019-108971

(51) Int. Cl.
*H01R 13/52* (2006.01)
*H01R 13/422* (2006.01)
*H01R 13/436* (2006.01)

(52) U.S. Cl.
CPC ..... *H01R 13/5202* (2013.01); *H01R 13/4223* (2013.01); *H01R 13/4367* (2013.01)

(58) Field of Classification Search
CPC ..... H01R 13/5202; H01R 13/4223; H01R 13/4367; H01R 13/50; H01R 13/6272
USPC ..... 439/351, 352, 595, 752
See application file for complete search history.

(56) References Cited

U.S. PATENT DOCUMENTS

| | | | | |
|---|---|---|---|---|
| 6,261,115 | B1 * | 7/2001 | Pederson | H01R 13/6272 439/352 |
| 6,478,620 | B1 | 11/2002 | Bonavita et al. | |
| 6,786,768 | B2 * | 9/2004 | Murakami | H01R 13/4365 439/271 |
| 9,923,298 | B2 * | 3/2018 | Hashimoto | H01R 13/5025 |
| 2002/0086580 | A1 * | 7/2002 | Kurimoto | H01R 13/4364 439/595 |
| 2002/0146281 | A1 | 10/2002 | Murakami | |
| 2007/0059969 | A1 | 3/2007 | Shamoto | |
| 2009/0247011 | A1 * | 10/2009 | Myer | H01R 13/4365 439/595 |
| 2014/0065865 | A1 * | 3/2014 | Mizutani | H01R 13/52 439/271 |
| 2014/0127928 | A1 * | 5/2014 | Kida | H01R 13/4223 439/345 |

(Continued)

FOREIGN PATENT DOCUMENTS

| | | |
|---|---|---|
| CN | 107039838 A | 8/2017 |
| EP | 1 235 306 A2 | 8/2002 |

(Continued)

*Primary Examiner* — Marcus E Harcum
(74) *Attorney, Agent, or Firm* — Kenealy Vaidya LLP

(57) ABSTRACT

A housing includes a housing main body provided with a terminal holding portion including a terminal accommodating chamber configured to accommodate a terminal, a retainer assembled to the terminal holding portion of the housing main body, and an annular seal member mounted to a tubular seal mounting portion formed on an assembly side to the retainer in the housing main body. The retainer includes an engaging piece protruding in a direction of assembling to the housing main body. The engaging piece is inserted into an inner side of the seal mounting portion and abuts on an inner surface of the seal mounting portion.

4 Claims, 11 Drawing Sheets

(56) References Cited

U.S. PATENT DOCUMENTS

| | | | | |
|---|---|---|---|---|
| 2016/0156130 | A1 | 6/2016 | Sekino | |
| 2017/0222354 | A1 | 8/2017 | Hashimoto et al. | |
| 2017/0222357 | A1 | 8/2017 | Hashimoto et al. | |
| 2018/0269623 | A1* | 9/2018 | Okamura | H01R 13/5841 |
| 2018/0287292 | A1* | 10/2018 | Furuya | H01R 13/516 |
| 2018/0331452 | A1* | 11/2018 | Iida | H01R 13/4361 |
| 2019/0067869 | A1* | 2/2019 | Hirota | H01R 13/5025 |
| 2020/0083633 | A1* | 3/2020 | Maesoba | H01R 13/113 |
| 2020/0099160 | A1* | 3/2020 | Masuda | H01R 13/516 |
| 2020/0153162 | A1* | 5/2020 | Mamiya | H01R 13/4223 |

FOREIGN PATENT DOCUMENTS

| | | | |
|---|---|---|---|
| JP | 2002-260766 | A | 9/2002 |
| JP | 2004-63393 | A | 2/2004 |
| JP | 2004-507036 | A | 3/2004 |
| JP | 2007-80621 | A | 3/2007 |
| JP | 2011-34882 | A | 2/2011 |
| JP | 2016-105353 | A | 6/2016 |
| JP | 2016-115411 | A | 6/2016 |
| JP | 2017-208168 | A | 11/2017 |
| WO | 02/01675 | A2 | 1/2002 |

* cited by examiner

HOUSING WITH AN ENGAGING PIECE

CROSS REFERENCE TO RELATED APPLICATIONS

This application claims priority from Japanese Patent Application No. 2019-108971 filed on Jun. 11, 2019, the entire contents of which are incorporated herein by reference.

BACKGROUND OF THE INVENTION

Field of the Invention

The present invention relates to a housing.

Description of Related Art

As a connector in which a male housing and a female housing are fitted to each other, there is a connector in which a fitting portion is sealed by an annular seal member such as a packing mounted on the female housing (see, for example, Patent Literatures 1 and 2).

[Patent Literature 1] JP-A-2016-105353

[Patent Literature 2] JP-A-2016-115411

In order to reduce a size of the connector, it is effective to reduce a thickness of each part of the housing made of resin. However, if the thickness of a mounting portion of the annular seal member in the female housing is reduced, strength of the mounting portion of the seal member may decrease, and the seal member may be deformed by a tightening force due to an elastic force of the seal member.

SUMMARY

One or more embodiments provide a housing that can ensure sufficient strength at a seal mounting portion to which an annular seal member is mounted while achieving a reduction in a size.

In an aspect (1), one or more embodiments provide a housing including a housing main body provided with a terminal holding portion having a terminal accommodating chamber configured to accommodate a terminal, a retainer assembled to the terminal holding portion of the housing main body, and an annular seal member mounted to a tubular seal mounting portion formed on an assembly side to the retainer in the housing main body. The retainer includes an engaging piece protruding in a direction of assembling to the housing main body. The engaging piece is inserted into an inner side of the seal mounting portion and abuts on an inner surface of the seal mounting portion.

In an aspect (2), the housing main body may include a lance protruding along the inner surface of the seal mounting portion and configured to lock the terminal accommodated in the terminal accommodating chamber. The engaging piece may be inserted between the inner surface of the seal mounting portion and the lance, and displacement of the lance in a direction opposite to a direction in which the terminal is locked may be restricted, in a state that the terminal is accommodated in the terminal accommodating chamber. The engaging piece may abut on the lance elastically deformed by the terminal in a state that the terminal is incompletely accommodated in the terminal accommodating chamber.

In an aspect (3), the lance may abut on an inner surface side of the engaging piece inserted between the lance and the inner surface of the seal mounting portion.

In an aspect (4), the housing main body may include a locking mechanism configured to lock a mating housing. The engaging piece may abut on at least the inner surface of the seal mounting portion on a locking mechanism side.

According to the aspect (1), the engaging piece of the retainer can abut against the inner surface of the seal mounting portion to which the annular seal member is mounted, so that the seal mounting portion can be supported. Accordingly, even when each part of the housing main body is made thin in order to reduce the size and weight, deformation of the seal mounting portion due to a tightening force of the seal member can be suppressed. That is, it is possible to ensure sufficient strength of the seal mounting portion to which the annular seal member is mounted while achieving a reduction in the size.

According to the aspect (2), the engaging piece has a double locking function of restricting the displacement of the lance and double locking the terminal and a detection function of detecting that the insertion of the terminal is incomplete by abutting on the lance. That is, by providing the engaging piece having a reinforcing function of the seal mounting portion with the double locking function and the double detection function, the size can be reduced by simplifying a structure and a shape as compared with a case where portions having the respective functions are provided.

According to the aspect (3), the lance abuts on the inner surface side of the engaging piece that abuts on the inner surface of the seal mounting portion and supports the seal mounting portion.

Therefore, the engaging piece that supports the seal mounting portion can be more firmly supported by the lance.

According to the aspect (4), the seal mounting portion on at least the locking mechanism side is supported by the engaging piece. As a result, the seal mounting portion on at least the locking mechanism side can be made thin so as to suppress bulkiness of the locking mechanism.

According to one or more embodiments, it is possible to provide the housing that can ensure sufficient strength at the seal mounting portion to which the annular seal member is mounted while achieving the reduction in the size.

The present invention has been briefly described above. Further, details of the present invention will be clarified by reading a mode (hereinafter, referred to as an "embodiment") for carrying out the invention to be described below with reference to the accompanying drawings.

DETAILED DESCRIPTION

Hereinafter, an embodiment of the present invention will be described with reference to the drawings.

Figure 1:
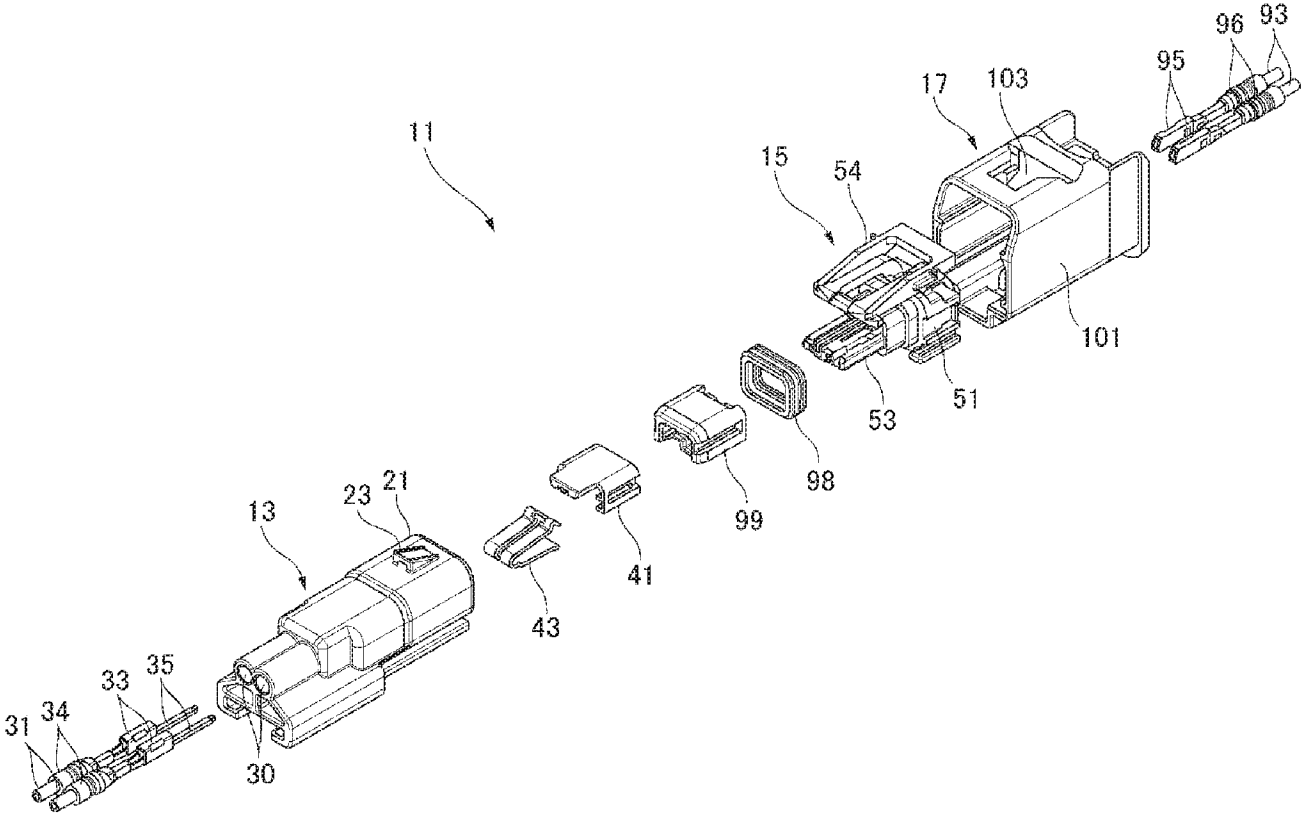
FIG. 1 is an exploded perspective view of a connector.
Figure 2:
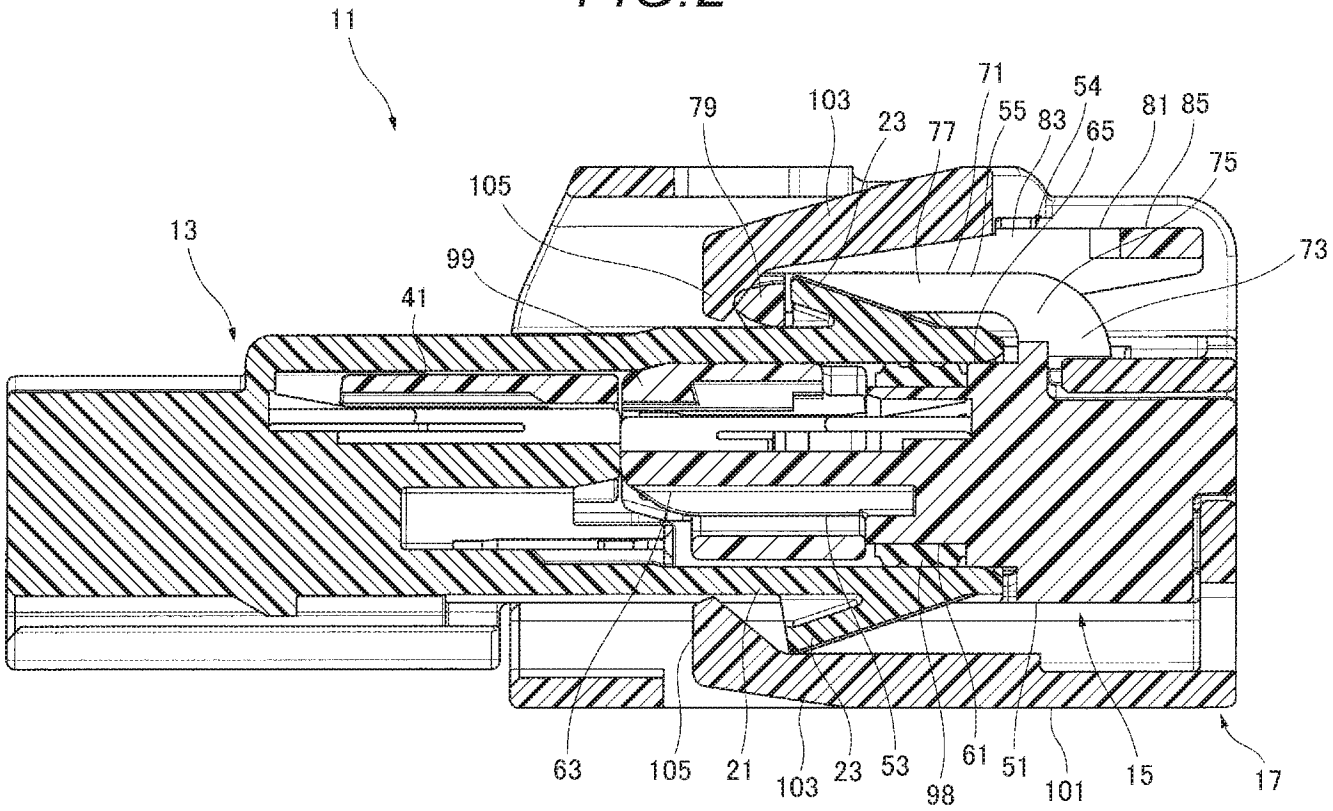
FIG. 2 is a sectional view of the connector along a fitting direction of a male housing and a female housing.

FIG. 1 is an exploded perspective view of a connector. FIG. 2 is a sectional view of the connector along a fitting direction of a male housing and a female housing, (Connector)

As shown in FIGS. 1 and 2, a female housing (a housing) 15 according to the present embodiment is fitted into a male housing (a mating housing) 13, and forms a connector 11 together with the male housing 13. The connector 11 includes a tubular CPA (connector position assurance) 17 that is slid and mounted from a rear side of the female housing 15. The male housing 13, the female housing 15, and the CPA 17 are each molded from a synthetic resin.

(Male Housing)

Figure 3:
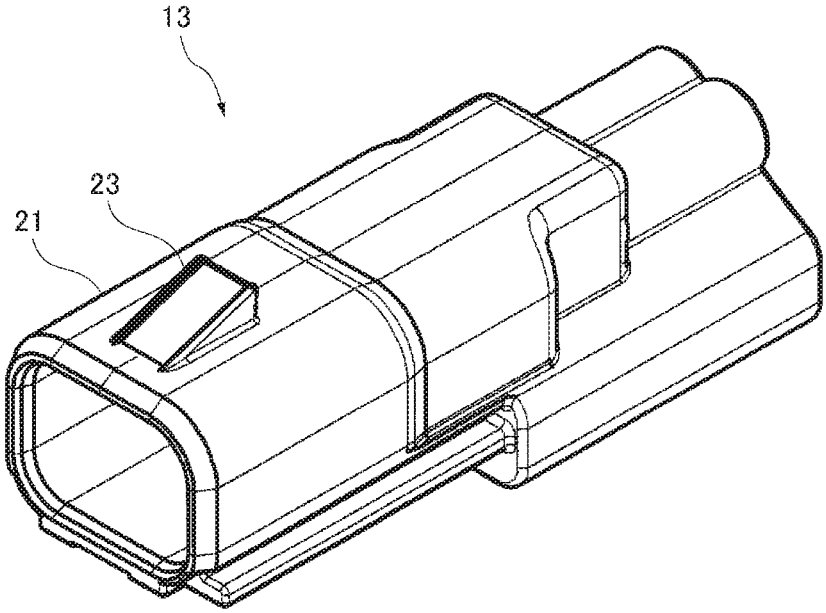
FIG. 3 is a perspective view of the male housing.

FIG. 3 is a perspective view of the male housing. FIG. 4A is a front view showing the male housing, and FIG. 4B is a side view showing the male housing.

Figure 4B:
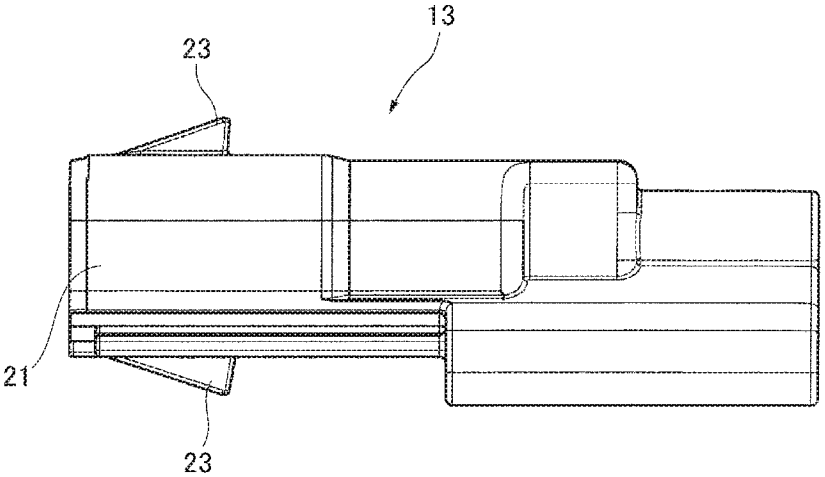
FIG. 4B is a side view showing the male housing.
Figure 4A:
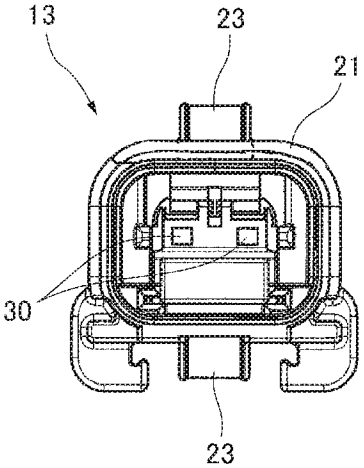
FIG. 4A is a front view showing the male housing.

As shown in FIGS. 3, 4A and 4B, the male housing 13 includes a hood portion 21 on a distal end side that is a fitting side with the female housing 15. Locking protrusions 23 are formed on upper and lower sides of the hood portion 21.

The male housing 13 includes two terminal accommodating chambers 30 on a rear side opposite to the fitting side with respect to the female housing 15. As shown in FIG. 1, male terminals 33 connected to end portions of electric wires 31 are respectively accommodated in the terminal accommodating chambers 30, and the electric wires 31 are drawn out from a rear end of the male housing 13. Rubber plugs 34 mounted to the electric wires 31 are fitted into the terminal accommodating chambers 30 from a rear end side of the male housing 13. Accordingly, the terminal accommodating chamber 30 of the male housing 13 accommodating the male terminal 33 is waterproofed.

The male terminal 33 is formed of, for example, a conductive metal material such as copper or a copper alloy, and the electric wire 31 is crimped and connected thereto. Each of the male terminals 33 includes a tab 35 formed in a pin shape, and the tab 35 is disposed in the hood portion 21.

A front holder 41 and a short terminal 43 are assembled to the male housing 13 from a front end side. The front holder 41 is formed of a synthetic resin, and when the front holder 41 is assembled to the male housing 13, the male terminal 33 inserted and accommodated in the terminal accommodating chamber 30 is held in a state of being accommodated in the terminal accommodating chamber 30. The short terminal 43 is formed of, for example, a conductive metal material such as copper or a copper alloy. When the short terminal 43 is assembled to the male housing 13, the short terminal 43 comes into contact with the tab 35 of the male terminal 33 in a non-fitted state in which the female housing 15 is not fitted to the male housing 13. As a result, the male terminals 33 are electrically connected to each other at the short terminal 43, and, for example, an interlock circuit is formed.

(Female Housing)

Figure 5:
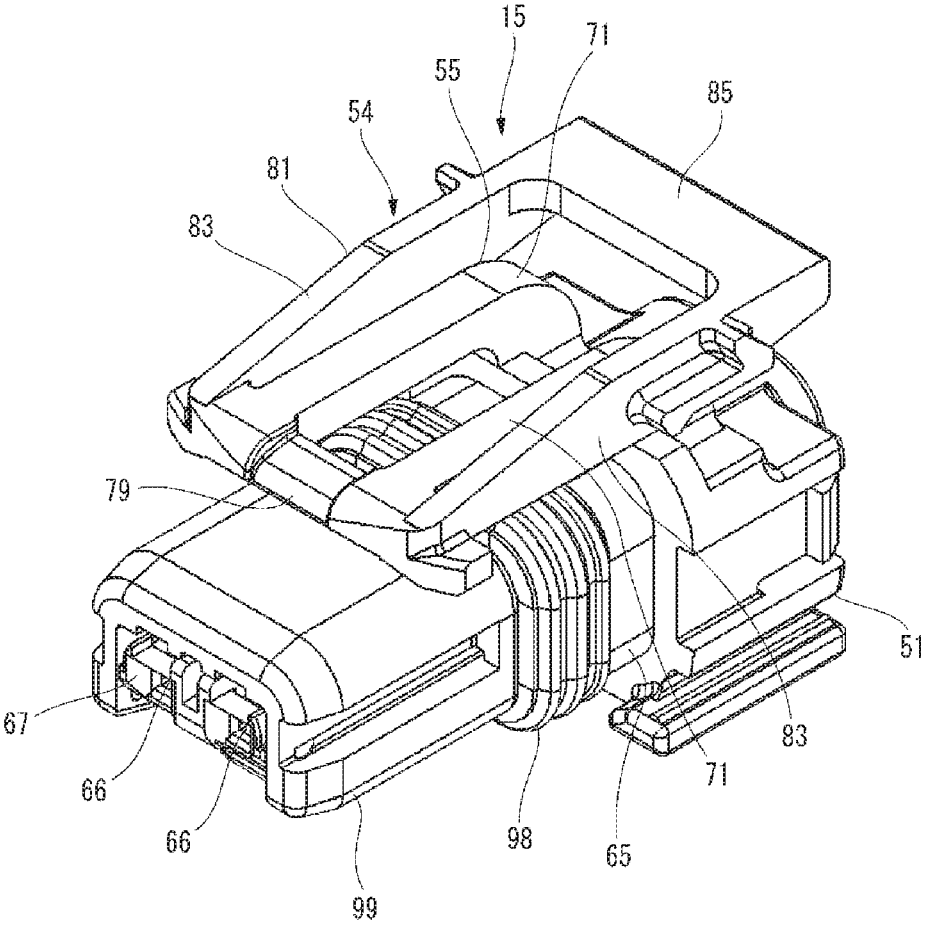
FIG. 5 is a perspective view of the female housing according to the present embodiment.
Figure 6B:
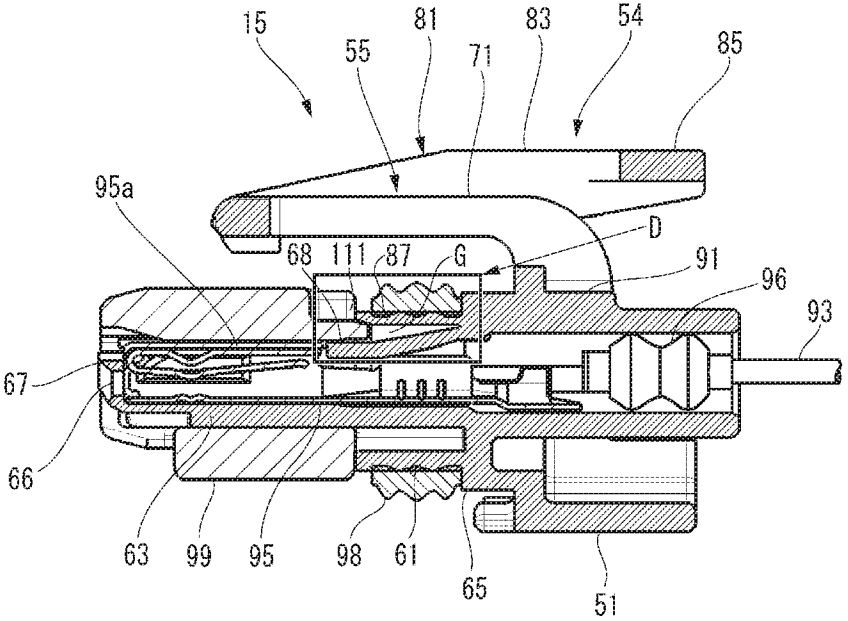
FIG. 6B is a sectional view taken along a line A-A in FIG. 6A.
Figure 6A:
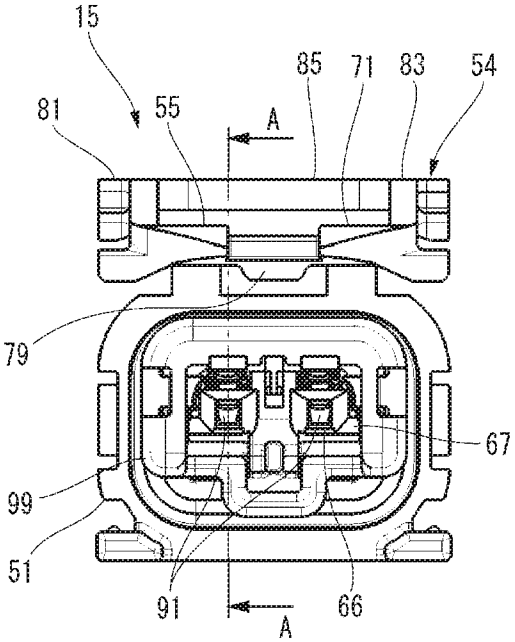
FIG. 6A is a front view showing the female housing.

FIG. 5 is a perspective view of the female housing according to the present embodiment. FIG. 6A is a front view showing the female housing according to the present embodiment. FIG. 6B is a sectional view taken along a line A-A in FIG. 6A.

As shown in FIGS. 5, 6A and 6B, the female housing 15 according to the present embodiment includes a housing main body 51. A seal member 98 and a retainer 99 are mounted to the housing main body 51 from the front side thereof.

Figure 7:
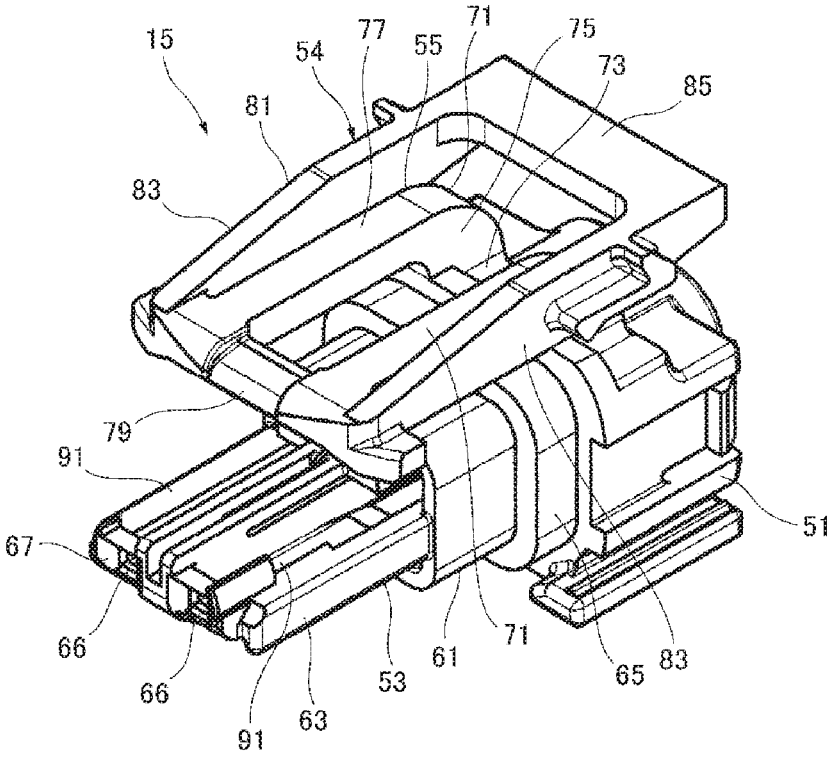
FIG. 7 is a perspective view of the female housing before a seal member and a retainer are mounted.
Figure 8B:
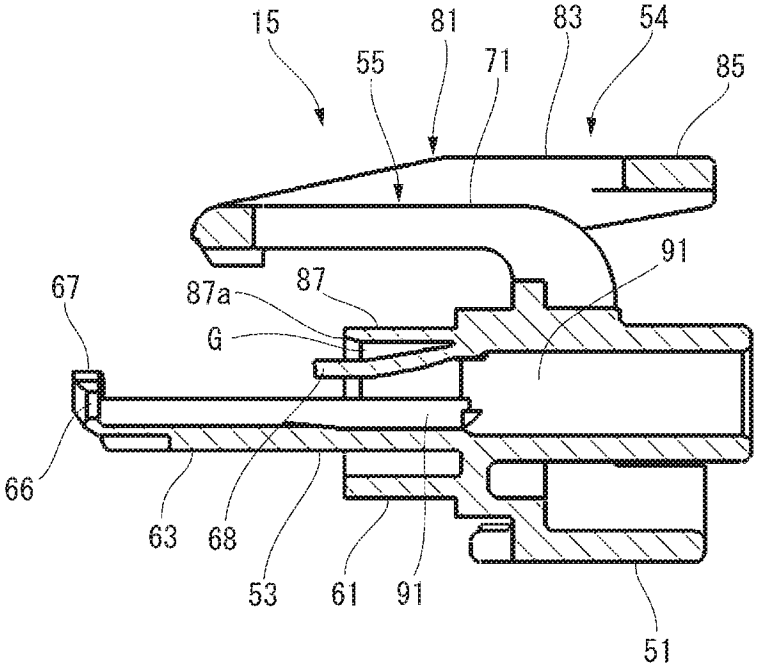
FIG. 8B is a sectional view taken along a line B-B in FIG. 8A.
Figure 8A:
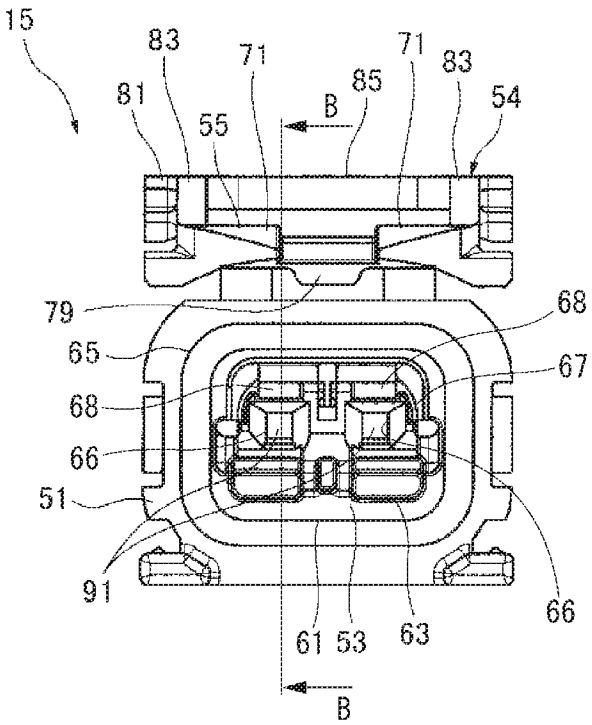
FIG. 8A is a front view showing the female housing before the seal member and the retainer are mounted.

FIG. 7 is a perspective view of the female housing before the seal member and the retainer are mounted, FIG. 8A is a front view showing the female housing before the seal member and the retainer are mounted. FIG. 8B is a sectional view taken along a line B-B in FIG. 8A.

As shown in FIGS. 7, 8A and 8B, the housing main body 51 of the female housing 15 is provided with a fitting protrusion 53, and a locking mechanism 54. The fitting protrusion 53 protrudes forward from the housing main body 51 in the fitting direction with the male housing 13, and is fitted into the hood portion 21 of the male housing 13. The fitting protrusion 53 includes a seal mounting portion 61 and a terminal holding portion 63 in an order from the housing main body 51 side. The terminal holding portion 63 protrudes forward from the seal mounting portion 61. In the female housing 15, an edge portion of the housing main body 51 on the fitting protrusion 53 side is a fitting edge portion 65 having a larger outer shape than the seal mounting portion 61.

The locking mechanism 54 is provided on an upper portion of the housing main body 51 in the female housing 15. The locking mechanism 54 includes a lock arm 55 and a release arm 81. The lock arm 55 includes a pair of elastic arm portions 71. Each of the elastic arm portions 71 includes a strut portion 73 formed above the housing main body 51, a bent portion 75 that is bent forward from the strut portion 73, and an extending portion 77 extending forward from the bent portion 75. Distal ends of the extending portions 77 of the elastic arm portions 71 are connected to each other, and the connection portion serves as a locking portion 79. The lock arm 55 swings when the elastic arm portions 71 are elastically deformed.

The release arm 81 includes a pair of support arm portions 83 that are connected to the distal ends of the elastic arm portions 71 and extend rearward, and an operation portion 85 that connects rear ends of the support arm portions 83. Each of the support arm portions 83 extends rearward of the female housing 15 beyond the strut portion 73 of the elastic arm portion 71. Accordingly, the operation portion 85 is disposed on the more rear side of the female housing 15 than the strut portion 73 of the elastic arm portion 71.

In the locking mechanism 54, the locking portion 79 of the lock arm 55 locks the locking protrusion 23 on an upper side of the hood portion 21 of the male housing 13 when the male housing 13 and the female housing 15 are fitted to each other. As a result, the male housing 13 and the female housing 15 are locked in a state of being fitted to each other.

Two terminal accommodating chambers 91 are formed in the female housing 15 from the housing main body 51 to the fitting protrusion 53. Female terminals 95 connected to end portions of electric wires 93 are respectively accommodated in the terminal accommodating chambers 91, and the electric wires 93 are drawn out from a rear end of the female housing 15. Rubber plugs 96 mounted to the electric wires 93 are fitted into the terminal accommodating chambers 91 from a rear end side of the female housing 15. Accordingly, the terminal accommodating chamber 91 of the female housing 15 accommodating the female terminal 95 is waterproofed.

An upper portion of the terminal holding portion 63 of the fitting protrusion 53 is opened. In addition, a front wall portion 67 including a pair of insertion openings 66 is formed at a distal end portion of the terminal holding portion 63. The insertion openings 66 of the front wall portion 67 are respectively formed at positions corresponding to the terminal accommodating chambers 91. A distal end portion of the female terminal 95 accommodated in the terminal accommodating chamber 91 abuts on the front wall portion 67 of the terminal holding portion 63, thereby restricting a forward movement of the female terminal 95.

A lance 68 is formed in each of the terminal accommodating chambers 91. The lance 68 is formed integrally with the housing main body 51, extends in the fitting direction, and projects toward an inner side of the terminal accommodating chamber 91.

The female terminal 95 includes an electrical connection portion 95*a* formed in a rectangular tubular shape, and the lance 68 locks a rear end of the electrical connection portion 95*a*. Specifically, when the female terminal 95 is inserted into the terminal accommodating chamber 91 of the housing main body 51, the lance 68 is temporarily elastically deformed outward by the electrical connection portion 95*a* of the female terminal 95, and is restored after the electrical connection portion 95*a* has passed. Accordingly, the female terminal 95 accommodated in the terminal accommodating chamber 91 is prevented from coining off from a rear end side of the housing main body 51 by the electrical connection portion 95*a* being locked to the lance 68.

A distal end of the lance 68 extends forward from the seal mounting portion 61. The seal mounting portion 61 is formed in a tubular shape. The seal mounting portion 61 includes a thin wall portion 87 on an upper side, and gaps G are formed between the thin wall portion 87 and the lances 68. In addition, a guide surface 87*a* that gradually inclines toward an outer peripheral side toward an end portion is formed on an inner peripheral side of the edge portion of the thin wall portion 87.

The seal member 98 mounted to the seal mounting portion 61 is made of an elastic material such as rubber, and is formed in an annular shape. The seal member 98 has an inner diameter slightly smaller than an outer diameter of the seal mounting portion 61. The seal member 98 is mounted to the seal mounting portion 61 of the fitting protrusion 53 from a front side while being expanded. As a result, the seal member 98 is mounted in a state of being in close contact with an outer peripheral surface of the seal mounting portion 61 by its elastic force.

Figure 9:
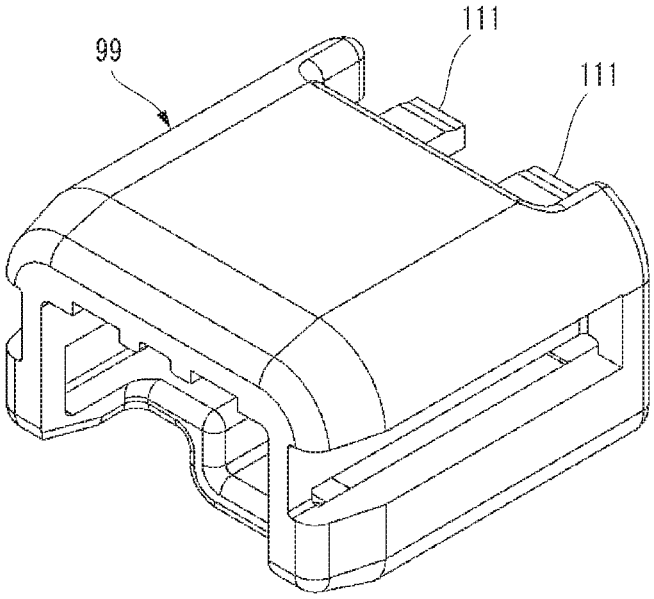
FIG. 9 is a perspective view of the retainer.
Figure 10B:
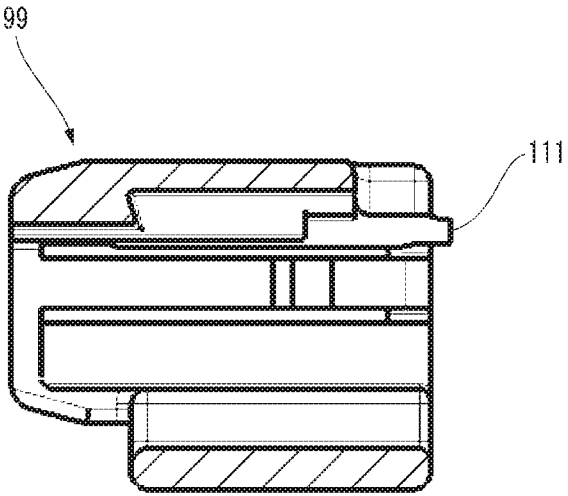
FIG. 10B is a sectional view taken along a line C-C in FIG. 10A.
Figure 10A:
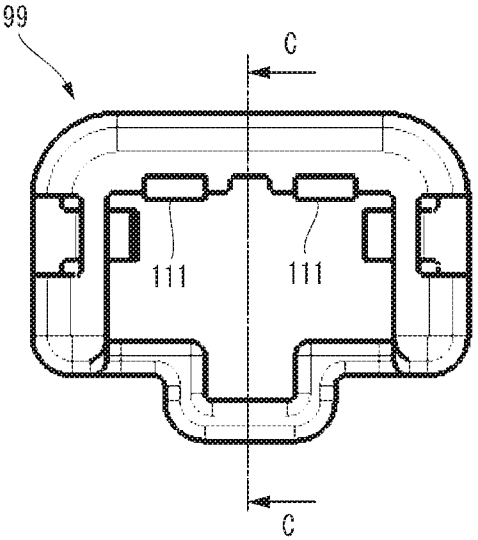
FIG. 10A is a front view showing the retainer.
Figure 11:
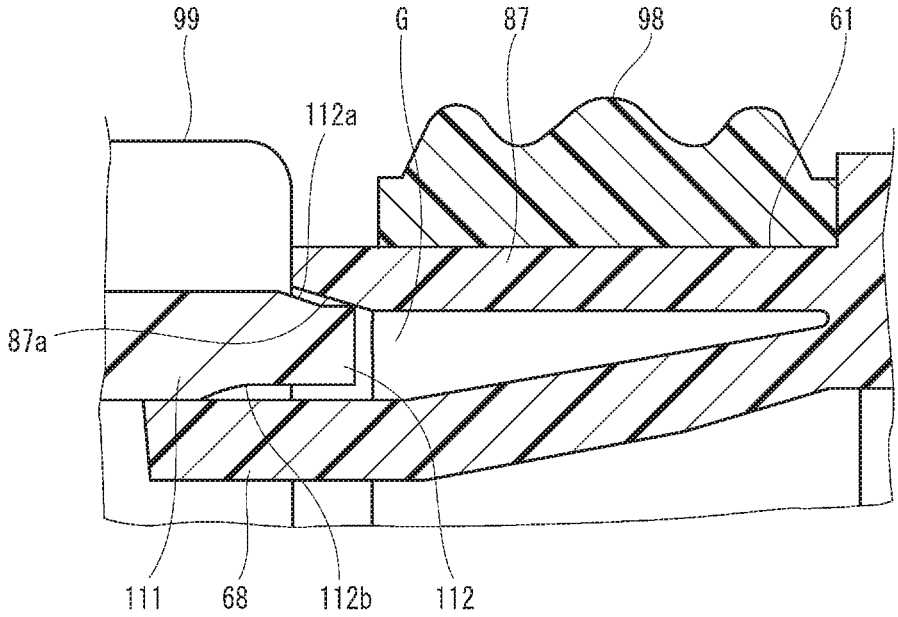
FIG. 11 is an enlarged view of a portion D in FIG. 6B.

FIG. 9 is a perspective view of the retainer. FIG. 10A is a front view showing the retainer. FIG. 10B is a sectional view taken along a line C-C in FIG. 10A. FIG. 11 is an enlarged view of a portion D in FIG. 6B.

As shown in FIGS. 9, 10A and 10B, the retainer 99 is formed in a tubular shape. The retainer 99 is formed of a synthetic resin. The retainer 99 is fitted to the terminal holding portion 63 of the fitting protrusion 53 of the housing main body 51 from the front side. By mounting the retainer 99 to the terminal holding portion 63, the upper portion of the terminal holding portion 63 whose upper side is opened is covered. As a result, the female terminal 95 inserted and accommodated in the terminal accommodating chamber 91 is held in a state that a periphery thereof is covered.

The retainer 99 is formed with a pair of engaging pieces III at a front end in a mounting direction to the housing main body 51. The engaging pieces 111 protrude from the retainer 99 in the mounting direction to the housing main body 51.

As shown in FIG. 11, the engaging pieces 111 are provided corresponding to the lances 68 formed in the housing main body 51, and are inserted into the gaps G between the thin wall portion 87 of the seal mounting portion 61 and the lances 68 by mounting the retainer 99 to the housing main body 51.

The engaging piece 111 includes a thin portion 112 whose end portion is formed to be thin. The engaging piece 111 includes a tapered surface 112*a*, which is inclined inward toward the thin portion 112, on an outer surface side thereof. In addition, the engaging piece 111 includes a tapered surface 112*b*, which is inclined outward toward the thin portion 112, on an inner surface side thereof.

The retainer 99 is assembled to the housing main body 51 in which the seal member 98 is mounted to the seal mounting portion 61 and the female terminal 95 is accommodated in the terminal accommodating chamber 91.

At this time, when the female terminal 95 is incompletely accommodated in the terminal accommodating chamber 91 during insertion, the lance 68 elastically deformed toward the thin wall portion 87 side by the electrical connection portion 95*a* remains elastically deformed without being restored. In this state, even when the retainer 99 is to be assembled to the housing main body 51, the engaging piece 111 abuts on the elastically deformed lance 68, so that the retainer 99 cannot be assembled to the housing main body 51. Therefore, an operator can recognize that an insertion failure of the female terminal 95 into the terminal accommodating chamber 91 occurs since the retainer 99 cannot be assembled.

When the retainer 99 is assembled to the housing main body 51, the engaging piece 111 is inserted into the gap G between the thin wall portion 87 of the seal mounting portion 61 and the lance 68. As a result, displacement of the lance 68 is restricted by the engaging piece 111, and a locking state of the female terminal 95 by the lance 68 is maintained. At this time, the engaging piece 111 abuts on an inner surface of the thin wall portion 87. Accordingly, the thin wall portion 87 is in a state that the end portion thereof is supported by the engaging piece 111. Further, the engaging piece 111 is in a state that the lance 68 abuts on an inner surface thereof. As a result, the engaging piece 111 supporting the end portion of the thin wall portion 87 is supported by the lance 68 from an inner side.

When the retainer 99 is assembled to the housing main body 51, the engaging piece 111 is guided by the guide surface 87*a* of the thin wall portion 87 and the tapered surface 112*a* and is smoothly inserted into an inner side of the thin wall portion 87 of the seal mounting portion 61. In addition, when the retainer 99 is assembled to the housing main body 51, the lance 68 is guided by the tapered surface 112*b* of the engaging piece 111 and is smoothly inserted into the inner side of the engaging piece 111. Therefore, when the retainer 99 is assembled to the housing main body 51, the engaging piece 111 can be smoothly inserted into the gap G between the thin wall portion 87 of the seal mounting portion 61 and the lance 68.

(CPA)

As shown in FIGS. 1 and 2, the CPA 17 includes a main body portion 101 formed in a rectangular tubular shape, and is mounted to the female housing 15 so as to cover the female housing 15 from rear and so as to be slidable in the fitting direction. The CPA 17 includes engaging arms 103 on upper and lower sides of the main body portion 101. The engaging arms 103 are supported by the main body portion 101 in a cantilever manner, and engaging claws 105 protruding inward are formed at a distal end portion thereof. When the CPA 17 is mounted to the female housing 15, the engaging claw 105 of the engaging arm 103 on the upper side abuts on a rear portion of the locking portion 79 of the lock arm 55.

(Fitting Procedure)

Next, the fitting of the male housing 13 and the female housing 15 will be described.

When the male housing 13 and the female housing 15 to which the CPA 17 is mounted are fitted, the locking portion 79 is pressed forward in the fitting direction by the engaging arm 103 on an upper side of the CPA 17.

When the locking portion 79 of the lock arm 55 gets over the locking protrusion 23 on the upper side of the hood portion 21 of the male housing 13 and locks to the locking protrusion 23, the male housing 13 and the female housing 15 are locked to each other in a fitted state. In addition, the engaging claw 105 of the engaging arm 103 on the upper side of the CPA 17 pushed forward in the fitting direction is engaged with the locking portion 79 of the lock arm 55 that locks the locking protrusion 23 on the upper side of the hood portion 21, and the engaging claw 105 of the engaging arm 103 on a lower side locks the locking protrusion 23 on the lower side of the hood portion 21. Accordingly, the CPA 17 is locked to the male housing 13 by the upper and lower engaging arms 103, and a locking state of the locking protrusion 23 by the locking portion 79 of the lock arm 55 is maintained by the engaging arm 103 on the upper side of the CPA 17 to ensure a fitting assurance state.

When the male housing 13 and the female housing 15 are fitted to each other, the fitting protrusion 53 of the female housing 15 to which the retainer 99 is mounted is inserted into the hood portion 21 of the male housing 13. As a result, the short terminal 43 is pushed down by the retainer 99 and is separated from the tab 35 of the male terminal 33, a short-circuit state of the male terminal 33 is released, and the tab 35 of the male terminal 33 is inserted into the female terminal 95 to be electrically connected to each other.

When the male housing 13 and the female housing 15 are fitted to each other, the seal member 98 mounted to the seal mounting portion 61 of the female housing 15 comes into close contact with an inner peripheral surface of the hood portion 21 of the male housing 13. As a result, a fitting portion between the male housing 13 and the female housing 15 is sealed (FIG. 2).

Incidentally, in order to reduce a size of the female housing 15, it is effective to reduce a thickness of each part. However, when a thickness of the seal mounting portion 61 formed in a tubular shape to which the annular seal member 98 is mounted is reduced, the seal mounting portion 61 may be deformed by a tightening force due to an elastic force of the seal member 98.

In the female housing 15 according to the present embodiment, by assembling the retainer 99 to the terminal holding portion 63 of the housing main body 51, the engaging piece 111 of the retainer 99 can abut against the inner surface of the thin wall portion 87 of the seal mounting portion 61 to which the annular seal member 98 is mounted, so that the seal mounting portion 61 can be supported. Accordingly, even when each part of the housing main body 51 is made thin in order to reduce the size and weight, deformation of the seal mounting portion 61 due to the tightening force of the seal member 98 can be suppressed. That is, it is possible to ensure sufficient strength of the seal mounting portion 61 to which the annular seal member 98 is mounted while achieving a reduction in the size.

The engaging piece 111 has a double locking function of restricting the displacement of the lance 68 and double locking the female terminal 95 and a detection function of detecting that the insertion of the female terminal 95 is incomplete by abutting on the lance 68. That is, by providing the engaging piece 111 having a reinforcing function of the seal mounting portion 61 with the double locking function and the double detection function, the size can be reduced by simplifying a structure and a shape as compared with a case where portions having the respective functions are provided.

The lance 68 abuts on the inner surface side of the engaging piece 111 that abuts on the inner surface of the thin wall portion 87 of the seal mounting portion 61 and supports the seal mounting portion 61. Therefore, the engaging piece 111 that supports the seal mounting portion 61 can be more firmly supported by the lance 68.

The seal mounting portion 61 on the locking mechanism 54 side is supported by the engaging piece 111. As a result, the seal mounting portion 61 includes the thin wall portion 87 on the locking mechanism 54 side, so that bulkiness of the locking mechanism 54 can be suppressed.

The present invention is not limited to the embodiment described above, and modifications, improvements, or the like can be made as appropriate. In addition, materials, shapes, dimensions, numbers, arrangement positions or the like of elements in the embodiment described above are optional and not limited as long as the present invention can be achieved.

Here, characteristics of the housing according to the embodiment of the present invention described above will be briefly summarized in the following [1] to [4], respectively.

[1] A housing (female housing 15) comprising:

a housing main body (51) provided with a terminal holding portion (63) including a terminal accommodating chamber (91) configured to accommodate a terminal (female terminal 95);

a retainer (99) assembled to the terminal holding portion (63) of the housing main body 51); and an annular seal member (98) mounted to a tubular seal mounting portion (61) formed on an assembly side to the retainer (99) in the housing main body (51), wherein the retainer (99) includes an engaging piece (111) protruding in a direction of assembling to the housing main body (51), and wherein the engaging piece (111) is inserted into an inner side of the seal mounting portion (61) and abuts on an inner surface of the seal mounting portion (61).

[2] The housing according to [1], wherein the housing main body (51) includes a lance (68) protruding along the inner surface of the seal mounting portion (61) and configured to lock the terminal (female terminal 95) accommodated in the terminal accommodating chamber (91), wherein the engaging piece (111) is inserted between the inner surface of the seal mounting portion (61) and the lance (68), and displacement of the lance (68) in a direction opposite to a direction in which the terminal (female terminal 95) is locked is restricted, in a state that the terminal (female terminal 95) is accommodated in the terminal accommodating chamber (91), and wherein the engaging piece (111) abuts on the lance (68) elastically deformed by the terminal (female terminal 95) in a state that the terminal (female terminal 95) is incompletely accommodated in the terminal accommodating chamber (91).

[3] The housing according to [2], wherein the lance (68) abuts on an inner surface side of the engaging piece (111) inserted between the lance (68) and the inner surface of the seal mounting portion (61).

[4] The housing according to any one of [1] to [3], wherein the housing main body (51) includes a locking mechanism (54) configured to lock a mating housing (male housing 13), and wherein the engaging piece (111) abuts on at least the inner surface of the seal mounting portion (61) on a locking mechanism (54) side.

DESCRIPTION OF REFERENCE NUMERALS AND SIGNS

13 male housing (mating housing
15 female housing (housing)
51 housing main body
54 locking mechanism
61 seal mounting portion
63 terminal holding portion
68 lance
91 terminal accommodating chamber
95 female terminal (terminal)
98 seal member
99 retainer
111 engaging piece

What is claimed is:

1. A housing comprising:

a housing main body provided with a terminal holding portion including a terminal accommodating chamber configured to accommodate a terminal;

a retainer assembled to the terminal holding portion of the housing main body; and an annular seal member mounted to a tubular seal mounting portion formed on an assembly side to the retainer in the housing main body, wherein the retainer includes an engaging piece protruding in a direction of assembling to the housing main body, wherein the engaging piece is inserted into an inner side of the seal mounting portion and abuts on an inner surface of the seal mounting portion, wherein the seal mounting portion includes a thin wall portion on an upper side, and a guide surface that gradually inclines toward an outer peripheral side toward an end portion is formed on an inner peripheral side of an edge portion of the thin wall portion, and wherein the engaging piece terminates at the guide surface and abuts the guide surface.

2. The housing according to claim 1, wherein the housing main body includes a lance protruding along the inner surface of the seal mounting portion and configured to lock the terminal accommodated in the terminal accommodating chamber, wherein the engaging piece is inserted between the inner surface of the seal mounting portion and the lance, and displacement of the lance in a direction opposite to a direction in which the terminal is locked is restricted, in a state that the terminal is accommodated in the terminal accommodating chamber, and wherein the engaging piece abuts on the lance elastically deformed by the terminal in a state that the terminal is incompletely accommodated in the terminal accommodating chamber.

3. The housing according to claim 2, wherein the lance abuts on an inner surface side of the engaging piece inserted between the lance and the inner surface of the seal mounting portion.

4. The housing according to claim 1, wherein the housing main body includes a locking mechanism configured to lock a mating housing, and wherein the engaging piece abuts on at least the inner surface of the seal mounting portion on a locking mechanism side.

* * * * *